US008128207B2

(12) United States Patent
Koseki

(10) Patent No.: US 8,128,207 B2
(45) Date of Patent: Mar. 6, 2012

(54) HEAD CHIP, LIQUID JET HEAD, LIQUID JET RECORDING DEVICE, AND METHOD OF MANUFACTURING THE HEAD CHIP

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 326 days.

(21) Appl. No.: 12/455,560

(22) Filed: Jun. 3, 2009

(65) Prior Publication Data

US 2009/0315957 A1 Dec. 24, 2009

(30) Foreign Application Priority Data

Jun. 4, 2008 (JP) ..... 2008-146863

(51) Int. Cl.
*B41J 2/045* (2006.01)

(52) U.S. Cl. ..... 347/68

(58) Field of Classification Search ..... 347/68, 347/69, 70–72, 50, 57–59
See application file for complete search history.

(56) References Cited

U.S. PATENT DOCUMENTS

| | | | | |
|---|---|---|---|---|
| 5,625,393 | A | 4/1997 | Asai | 347/69 |
| 7,735,977 | B2 * | 6/2010 | Murata | 347/70 |
| 7,871,152 | B2 * | 1/2011 | Suzuki et al. | 347/50 |
| 2005/0237365 | A1 * | 10/2005 | Hiwada | 347/58 |
| 2007/0182787 | A1 * | 8/2007 | Kubo et al. | 347/58 |

FOREIGN PATENT DOCUMENTS

| | | |
|---|---|---|
| JP | 07186381 | 7/1995 |
| JP | 09207331 | 8/1997 |
| JP | 11115195 | 4/1999 |
| JP | 2002127422 | 5/2002 |
| JP | 2002210955 | 7/2002 |
| JP | 2007229976 | 9/2007 |

* cited by examiner

*Primary Examiner* — Kristal Feggins
(74) *Attorney, Agent, or Firm* — Adams & Wilks

(57) ABSTRACT

A head chip for a liquid jet recording device has a pair of piezoelectric elements that form a liquid jet channel therebetween, a common electrode formed on a surface of each piezoelectric element on the liquid jet channel side, and a drive electrode formed on an opposite surface of the piezoelectric element. A cover plate is joined so as to cover a common terminal connected to the common electrode, and an integrated wiring that integrates and electrically connects all of the common terminals is formed on a surface of the cover plate. The integrated wiring is connected to the common terminals through the contact plugs formed in through-holes of the cover plate. Integrated terminals connected to the integrated wiring and drive terminals connected to the drive electrodes are arranged in line at an end of an actuator plate.

9 Claims, 10 Drawing Sheets

HEAD CHIP, LIQUID JET HEAD, LIQUID JET RECORDING DEVICE, AND METHOD OF MANUFACTURING THE HEAD CHIP

BACKGROUND OF THE INVENTION

1. Field of the Invention

The present invention relates to a head chip, a liquid jet head, a liquid jet recording device, and a method of manufacturing the head chip.

2. Description of the Related Art

In recent years, there have been provided a large number of liquid jet type recording devices that eject an ink droplet on a recording medium such as a recording paper for recording an image or a character thereon. For example, a printer or a facsimile is an example thereof. The recording device supplies ink to a head chip from an ink tank through an ink supply pipe, and ejects ink onto the recording medium from a nozzle of the head chip for recording.

FIG. 9 is a plan view of a head chip according to a related art, and FIG. 10 is a cross-sectional view taken along the line E-E of FIG. 9. As illustrated in FIG. 10, a head chip 41 includes an actuator plate 15 with a plurality of channels 12, a nozzle plate 14 with nozzles 13 that communicate with the channels 12, and a cover plate 16 that covers the channels 12.

FIG. 5 is a cross-sectional view of a part taken along the line F-F of FIG. 9. As illustrated in FIG. 5, liquid jet channels (hereinafter referred to simply as "jet channels") 12A that eject ink, and dummy channels 12B that eject no ink are alternately formed in the actuator plate 15. The entire actuator plate 15 is made of a piezoelectric material, and thus the jet channel 12A is held between a pair of piezoelectric elements 11. Each of the piezoelectric elements 11 includes a common electrode 18*a* on the jet channel 12A side, and a drive electrode 18*b* on the dummy channel 12B side. The common electrodes 18*a* are grounded, and the same voltage is applied to the drive electrodes 18*b* of the pair of piezoelectric elements 11 that hold each jet channel 12A. As a result, a pressure fluctuation is generated in the ink that is filled inside the jet channel 12A, and an ink droplet is ejected from each nozzle 13.

As illustrated in FIG. 10, a common terminal 19*a* connected to the common electrode 18*a* is formed on a surface of the actuator plate 15. As illustrated in FIG. 9, a drive terminal 19*b* connected to each drive electrode is also formed on the surface of the actuator plate 15. The common electrodes 19*a* and the drive terminals 19*b* are connected externally, and thus a flexible substrate 90 is mounted on a surface end of the actuator plate 15 through an anisotropic conductive film (not shown) or the like. That is, wirings 92*a* and 92*b* of the flexible substrate 90 are connected to the common terminals 19*a* and the drive terminals 19*b* of the actuator plate 15, respectively. As illustrated in FIG. 10, in order to prevent the common terminals 19*a* and the drive terminals 19*b* from being short-circuited by the wirings 92 of the flexible substrate 90, a coverlay 98 made of an insulating material is formed on the surfaces of the wirings 92.

As illustrated in FIG. 9, common terminals 19*a* and drive terminals 19*b* are arranged at narrow pitches. For that reason, there is a risk that those terminals may be short-circuited when the flexible substrate 90 is mounted. In particular, in recent years, in order to record highly fine images and characters on a recording medium, the pitches of the jet channels of the head chip 41 are required to be narrow. Along with the narrowed pitches of the jet channels, the pitches of the respective terminals 19*a* and 19*b* are further narrowed. Therefore, the above-mentioned problem becomes more remarkable.

Further, the respective terminals 19*a* and 19*b* of the actuator plate 15 and the wirings 92 of the flexible substrate 90 are small in line width because those elements are arranged at narrow pitches. On the other hand, the actuator plate 15 is made of a ceramic-based piezoelectric material whereas the flexible substrate 90 is made of a resin material such as polyimide. For that reason, those members are largely different in linear thermal expansion coefficient from each other, and a difference in the amount of expansion and contraction between those members due to a temperature change becomes large. As a result, it is difficult to align the respective terminals of the actuator plate 15 with the wirings of the flexible substrate 90.

JP 09-29977 A discloses a configuration in which, in order to facilitate the connection of electric wirings even if the groove intervals of an ink chamber are narrowed, electrode extraction parts that are rendered conductive to an electrode disposed within the ink chamber is formed on the surface of a piezoelectric ceramic substrate, and the intervals of the electrode extraction parts are radially formed so as to be larger than the intervals of the electrodes. However, the technology of JP 09-29977 A has such a problem that the intervals of the electrode extraction parts are widened, and hence the piezoelectric ceramics substrate large in width is required, resulting in the upsized ink jet head.

SUMMARY OF THE INVENTION

The present invention has been made in view of the above-mentioned problems, and therefore an object of the present invention is to provide a head chip, a liquid jet head, a liquid jet recording device, and a method of manufacturing the head chip, which are capable of preventing short-circuit between terminals, and facilitating alignment when a flexible substrate is mounted.

In order to solve the above-mentioned problems, a head chip according to the present invention includes: a plurality of liquid jet channels formed in an actuator plate; nozzles that communicate with the plurality of liquid jet channels and eject liquid; a pair of piezoelectric elements that hold each of the plurality of liquid jet channels therebetween; common electrodes formed on surfaces of the pair of piezoelectric elements on the liquid jet channel side; drive electrodes formed on surfaces of the pair of piezoelectric elements, the surfaces being opposite to the surfaces on which the common electrodes are formed; common terminals connected to the common electrodes and formed on a surface of the actuator plate; an integrated plate that covers a plurality of the common terminals; and an integrated wiring that is formed on a surface of the integrated plate and integrates at least a part of the plurality of common terminals, in which the integrated wiring is connected to the common terminals through through-holes of the integrated plate, and in which the actuator plate includes integrated terminals connected to the integrated wiring and drive terminals connected to the drive electrodes, the integrated terminals and the drive terminals being arranged at an end thereof.

According to the present invention, an integrated wiring into which at least a part of the plurality of common terminals are integrated is formed, and thus the integrated terminal connected to the integrated wiring and the drive terminals connected to the drive electrodes are arranged at the end of the actuator plate. Therefore, the number of terminals is reduced as compared with a case in which all of the common terminals and the drive electrodes are arranged in line, and the respective terminals can be arranged at wide pitches. As a result, short-circuit between the terminals can be prevented. In addition, the line width of the respective terminals can be made larger, whereby alignment when the flexible substrate is mounted can be facilitated.

Further, the through-holes each desirably include a contact plug formed therein, and the integrated wiring is desirably connected to the common terminals through the contact plug formed in each of the through-holes of the integrated plate.

According to the present invention, the contact plug is provided, and hence the integrated terminal and the common terminal can be surely connected to each other.

Further, the integrated plate desirably has a linear thermal expansion coefficient equal to a linear thermal expansion coefficient of the actuator plate.

In this case, amounts of expansion and contraction due to a temperature change are equal to each other between the actuator plate and the integrated plate. Accordingly, the alignment of the through-holes of the integrated plate with respect to the common terminals of the actuator plate can be easily performed irrespective of temperature.

Further, the integrated plate is desirably a cover plate that covers the plurality of liquid jet channels.

In this case, it is unnecessary to provide an additional integrated plate, and hence the manufacturing costs can be reduced.

Further, the common electrodes are desirably ground electrodes.

In this case, the operation accuracy of the piezoelectric element can be improved.

Further, a pair of the integrated terminals connected to both ends of the integrated wiring are desirably arranged at both ends of a plurality of the drive terminals.

In this case, variations in potential of the plurality of common terminals can be reduced as compared with a case in which the integrated terminal is connected to only one end of the integrated wiring, thereby improving the operation accuracy of the piezoelectric element.

Meanwhile, a liquid jet head according to the present invention includes the head chip according to the present invention.

According to the present invention, there is provided the head chip which is capable of preventing short-circuit between the terminals, and hence there can be provided the liquid jet head excellent in electric reliability.

Meanwhile, a liquid jet recording device according to the present invention includes: the liquid jet head according to the present invention; liquid supply means for supplying a liquid to the plurality of liquid jet channels of the head chip; and recording medium conveying means for conveying a recording medium so as to pass through a position that faces the nozzles.

According to the present invention, there is provided the head chip which is capable of preventing short-circuit between the terminals, and hence there can be provided the liquid jet head excellent in electric reliability.

Meanwhile, a method of manufacturing the head chip according to the present invention includes: aligning the through-holes of the integrated plate to the common terminals formed on the surface of the actuator plate to join the integrated plate to the surface of the actuator plate with an adhesive; removing the adhesive that has flowed into the through-holes; and forming the contact plugs inside the through-holes.

According to the present invention, there can be provided the head chip which makes it possible to surely connect the contact plugs and the common terminals, and is excellent in the electric reliability.

According to the head chip of the present invention, the integrated wiring into which at least a part of the plurality of common terminals are integrated is formed, and the integrated terminals connected to the integrated wiring and the drive terminals connected to the drive electrodes are arranged at the ends of the actuator plate. Therefore, the number of terminals is reduced as compared with a case in which all of the common terminals and drive electrodes are arranged in line, and the respective terminals can be arranged at wide pitches. As a result, short-circuit between the terminals can be prevented. In addition, the line width of the respective terminals can be increased, and hence alignment when the flexible substrate is mounted can be facilitated.

DETAILED DESCRIPTION OF THE PREFERRED EMBODIMENT

Hereinafter, a description is given of an embodiment of the present invention with reference to the accompanying drawings.

(Liquid Jet Recording Device)

Figure 1:
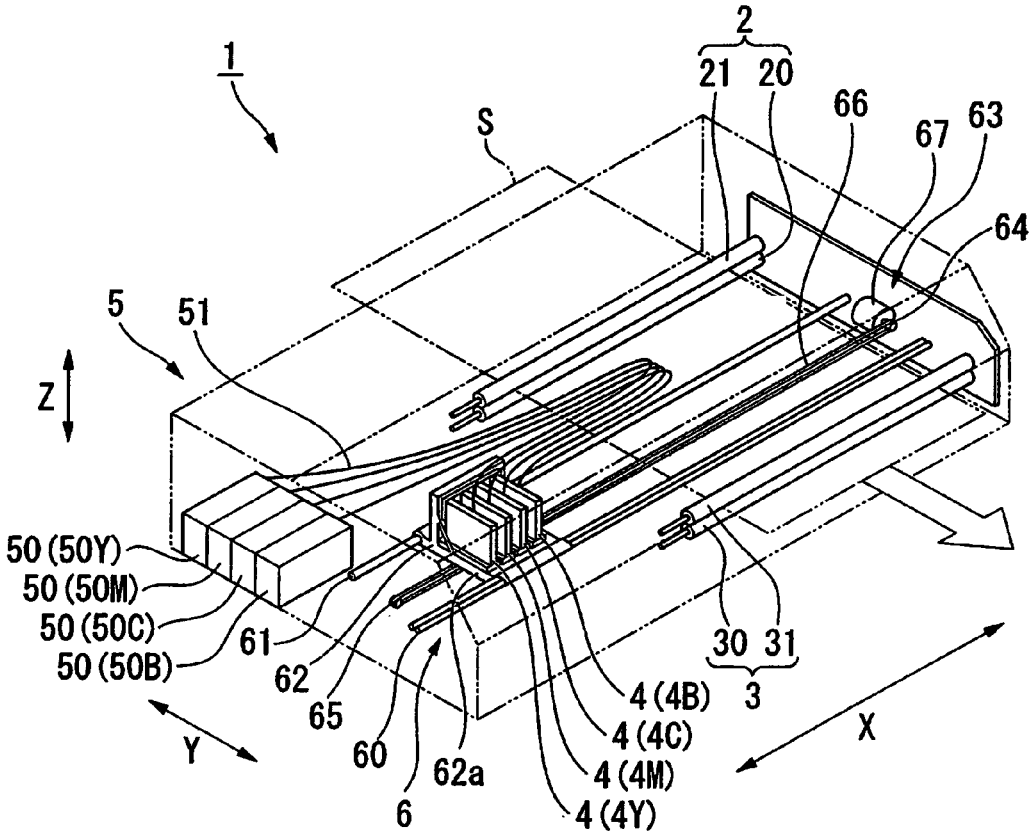
FIG. 1 is a perspective view illustrating an example of a liquid jet recording device.
Figure 2:
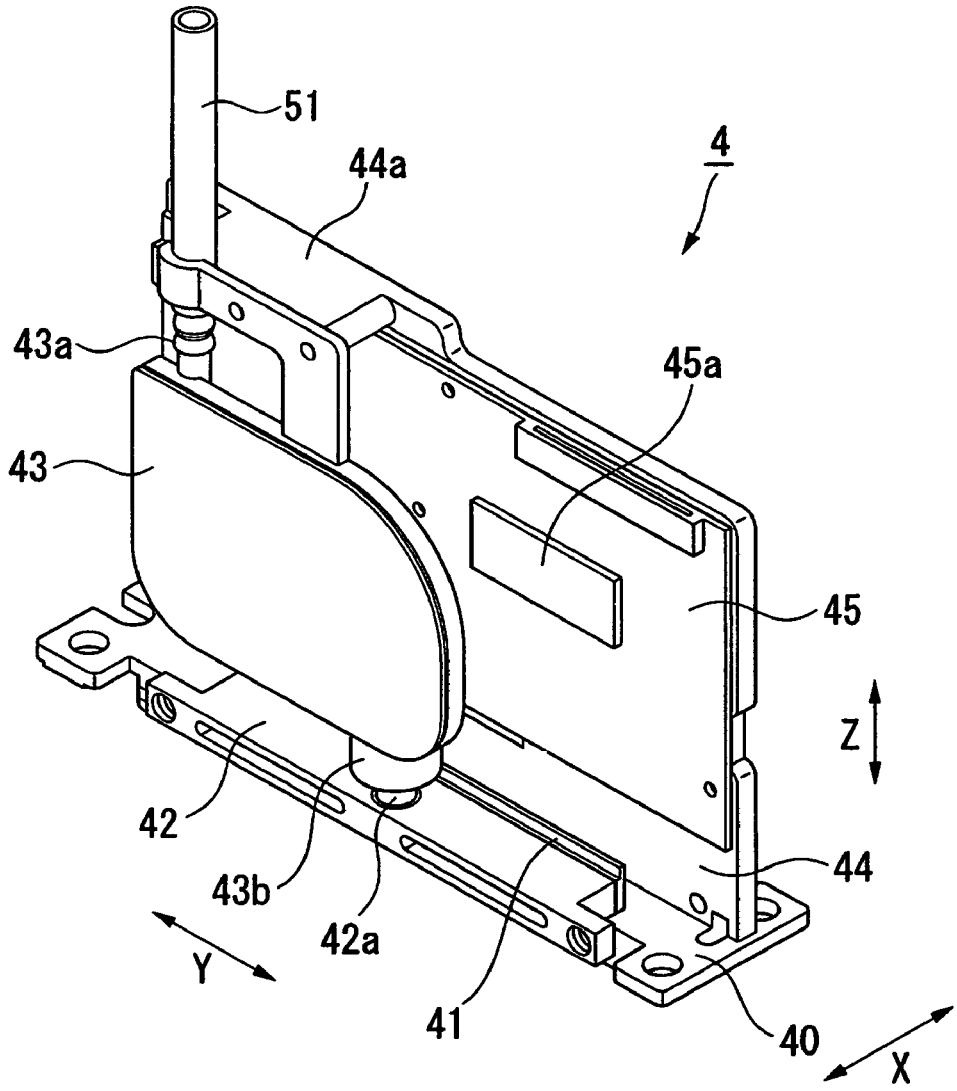
FIG. 2 is a perspective view illustrating a liquid jet head.
Figure 3:
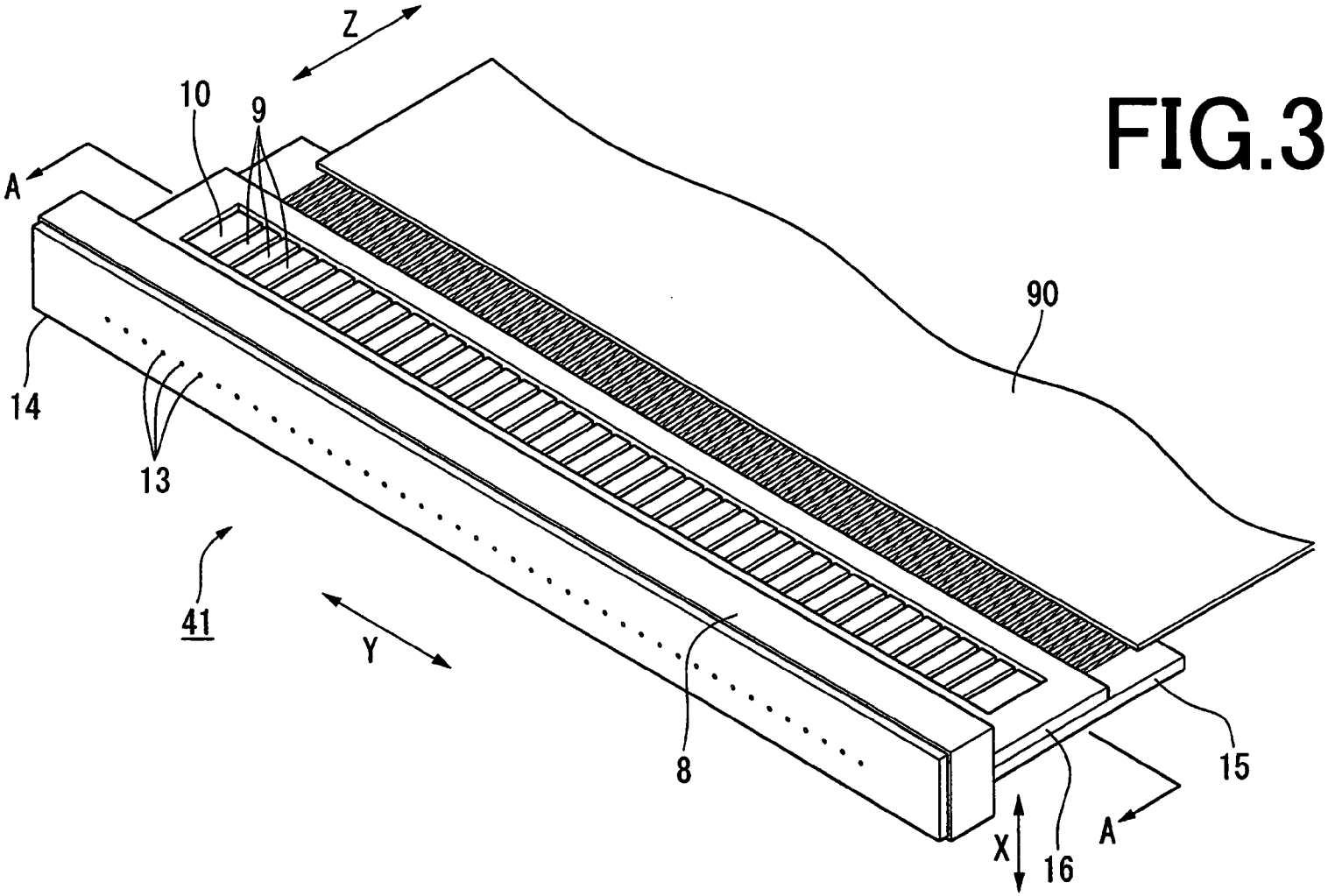
FIG. 3 is a perspective view illustrating a head chip according to an embodiment of the present invention.
Figure 4:
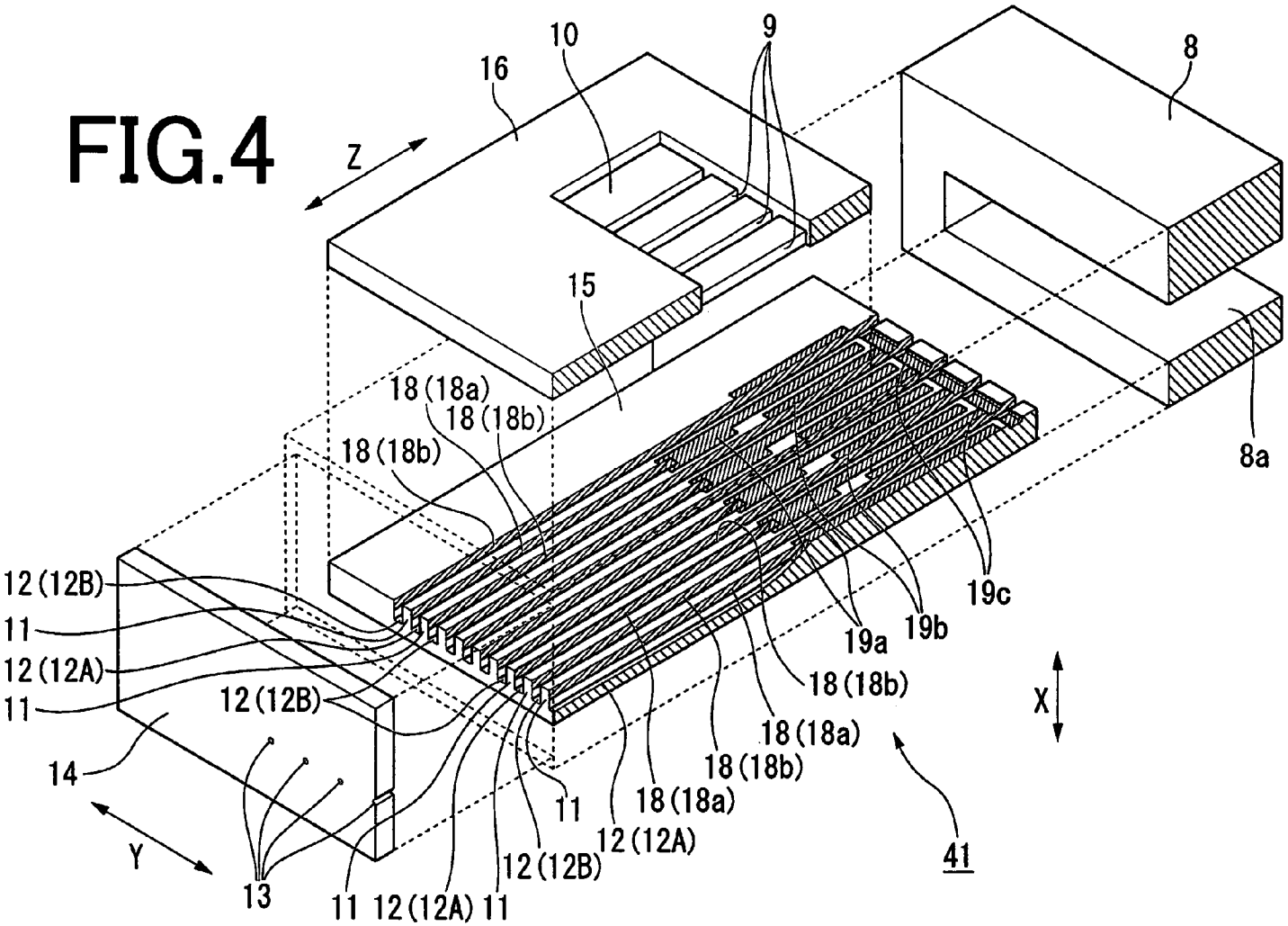
FIG. 4 is an exploded perspective view of the head chip according to the embodiment.
Figure 5:
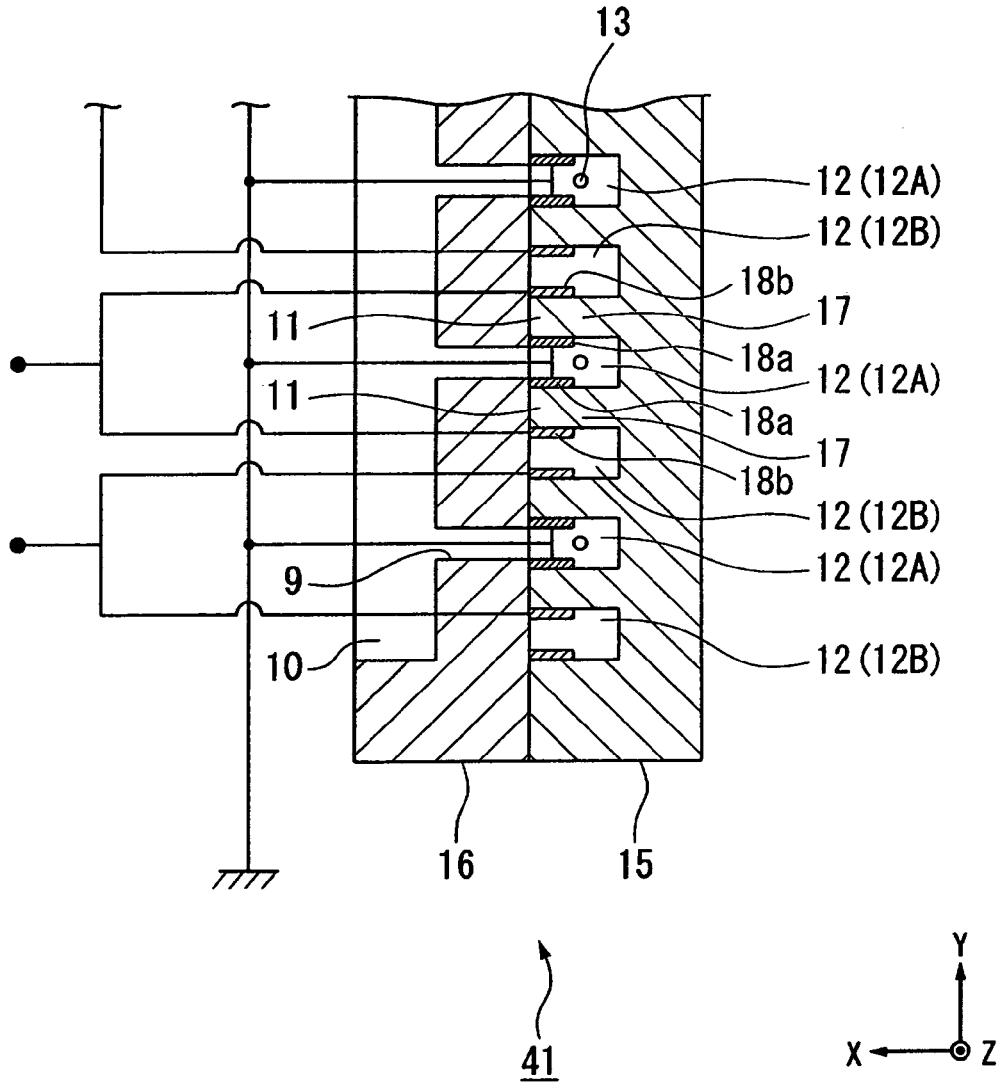
FIG. 5 is a cross-sectional view taken along the line A-A of FIG. 3.

FIG. 1 is a perspective view illustrating an example of a liquid jet recording device. FIG. 2 is a perspective view illustrating an example of a liquid jet head. FIG. 3 is a perspective view illustrating a head chip according to this embodiment. FIG. 4 is an exploded perspective view of the head chip according to this embodiment. FIG. 5 is a cross-sectional view taken along the line A-A of FIG. 3.

As illustrated in FIG. 1, a liquid jet recording device 1 includes a pair of conveying means 2, 3 that convey a recording medium S such as a paper, a liquid jet head 4 that ejects ink onto the recording medium S, ink supply means 5 for supplying ink to the liquid jet head 4, and scanning means 6 for causing the liquid jet head 4 to perform scanning in a direction (hereinafter referred to as "X direction") substantially orthogonal to the conveying direction (hereinafter referred to as "Y direction") of the recording medium S.

The pair of conveying means 2 and 3 include grid rollers 20 and 30 extending in the X direction, pinch rollers 21 and 31 extending in parallel to the grid rollers 20 and 30, and a drive mechanism (not shown) such as a motor, which axially rotates the grid rollers 20 and 30.

The ink supply means 5 includes an ink tank 50 in which ink is housed, and an ink supply pipe 51 that connects the ink tank 50 to the liquid jet head 4. There are provided a plurality of the ink tanks 50, and more specifically, ink tanks 50Y, 50M, 50C, and 50B for four kinds of ink consisting of yellow, magenta, cyan, and black are aligned in the Y direction. The ink supply pipe 51 is formed of a flexible hose having flexibility adaptive to the operation of the liquid jet head 4 (carriage 62).

The scanning means 6 includes a pair of guide rails 60 and extending in the X direction, a carriage 62 slidable along the pair of guide rails 60 and 61, and a drive mechanism 63 that moves the carriage 62 in the X direction. The drive mechanism 63 includes a pair of pulleys 64 and 65 disposed between the pair of guide rails and 61, an endless belt 66 winded around the pair of pulleys and 65, and a drive motor 67 that rotationally drives the pulley of the pair. The pair of pulleys 64 and 65 are disposed between both ends of the pair of guide rails 60 and 61, respectively, and arranged at an interval in the X direction. The endless belt 66 is disposed between the pair of guide rails 60 and 61, and the endless belt is coupled with the carriage 62. The plurality of liquid jet heads 4 are mounted on the carriage 62, and more specifically, liquid jet heads 4Y, 4M, 4C, and 4B for four kinds of ink consisting of yellow, magenta, cyan, and black are aligned in the X direction for mounting.

As illustrated in FIG. 2, the liquid jet head 4 includes a mounting base 40, a head chip 41, a passage substrate 42, a pressure adjustment part 43, a base plate 44, and a wiring substrate 45. The mounting base 40 is fixed to a base 62*a* of the carriage 62 illustrated in FIG. 1 with a screw or the like.

As illustrated in FIG. 2, the head chip 41 is fitted to the mounting base 40. The passage substrate 42 is fitted to one surface side of the head chip 41. A circulation path (not shown) for circulating ink is formed inside the passage substrate 42, and an inflow port 42*a* that communicates with the circulation path is formed on the upper surface of the passage substrate 42. The pressure adjustment part 43 is configured to absorb the pressure fluctuation of ink, and includes a reservoir (not shown) for reserving ink. The pressure adjustment part 43 is fixed to a leading end of a support part 44*a* projecting from the upper end of the base plate 44. The upper portion of the pressure adjustment part 43 is equipped with an ink intake port 43*a* that is connected with the ink supply pipe 51, and the lower portion of the pressure adjustment part 43 is equipped with an ink supply port 43*b* that is connected to the inflow port 42*a* of the passage substrate 42. The base plate 44 is erected substantially perpendicular to the upper surface of the mounting base 40, and the wiring substrate 45 is fitted to the surface of the base plate 44. On the wiring substrate 45, a control circuit 45*a* that controls the head chip 41 is formed.

(Head Chip)

As illustrated in FIGS. 3 and 4, the head chip 41 includes an ink chamber 10 for housing ink therein, piezoelectric elements 11 deformable by applying a voltage thereto, a plurality of channels 12 that are partitioned by the piezoelectric elements 11 and formed in parallel to each other, and nozzle openings 13 that each eject an ink droplet toward the recording medium S illustrated in FIG. 1.

More specifically, the head chip 41 illustrated in FIGS. 3 and 4 is a so-called independent channel type head chip, which includes a nozzle plate 14 in which the nozzle openings 13 are formed, an actuator plate 15 including a plurality of channels 12 formed by erecting the plurality of piezoelectric elements 11 at intervals in parallel, a cover plate 16 that covers the channels 12, and a nozzle cap 8 for supporting the nozzle plate 14.

The actuator plate 15 is a rectangular plate made of a piezoelectric material such as lead zirconate titanate (PZT). On one surface side of the actuator plate 15 concave groove-like channels 12 that are rectangular in cross section and extend in the lateral direction (hereinafter referred to as "Z direction") of the actuator plate 15 are formed. A plurality of channels 12 are arranged at given intervals in the longitudinal direction (Y direction) of the actuator plate 15.

As illustrated in FIGS. 4 and 5, as the above-mentioned channels 12, jet channels 12A (common channels) that allow ink droplets to be ejected, and dummy channels 12B that do not allow ink droplets to be ejected are alternately disposed. The jet channels 12A each communicate with the nozzle opening 13 and also communicate with the ink chamber 10 through an ink introduction aperture 9. On the other hand, the dummy channels 12B each do not communicate with the ink chamber 10 and the nozzle opening 13. That is, the ejection of ink droplets toward the recording medium S from the dummy channels 12B, and the supply of ink from the ink chamber 10 to the dummy channels 12B are each blocked.

Further, as illustrated in FIG. 4, the leading ends (ends on the nozzle opening 13 side) of the jet channels 12A and the dummy channels 12B extend up to the end surface of the actuator plate 15 with the same depth being kept. The leading ends of the jet channels 12A and the dummy channels 12B are closed by the nozzle plate 14. Bottom surfaces of base ends (ends on the side opposite to the nozzle openings 13 side) of the jet channels 12A and the dummy channels 12B are inclined (FIG. 7), and the base ends of the jet channels 12A and the dummy channels 12B are gradually shallower toward the base end side.

As illustrated in FIGS. 4 and 5, each of the piezoelectric elements 11 is formed between the adjacent channels 12. The piezoelectric elements 11 each have a piezoelectric body 17 that is rectangular in cross section. The piezoelectric body 17 is a side wall formed between the adjacent channels 12 and extending in the Z direction. That is, a plurality of rectangular grooves (channels 12) are formed on one surface side of the plate made of a piezoelectric material at given pitches in parallel, to thereby form the actuator plate 15.

Further, a common electrode 18*a* is disposed on each jet channel 12A side of the piezoelectric bodies 17, and a drive electrode 18*b* is disposed on each dummy channel 12B side of the piezoelectric bodies 17. The common electrodes 18*a* and the drive electrodes 18*b* are band-like electrodes extending in the Z direction, and deposited on the upper portions of the side surfaces of the piezoelectric bodies 17. The two drive electrodes 18*b* disposed on a pair of piezoelectric elements 11 that hold the jet channel 12A therebetween, respectively, are mutually coupled with each other so as to be applied with the same voltage. All of the common electrodes 18*a* are grounded.

Further, as illustrated in FIG. 4, on the surface of the actuator plate 15, common terminals 19*a*, drive terminals 19*b*, and coupling portions 19*c* are formed. The common terminals 19*a* are disposed on one surface side of the base end of the actuator plate 15, and are coupled with the base ends of the pair of common electrodes 18*a* disposed on the inner wall surfaces of the jet channels 12A. The drive terminals 19*b* are disposed at intervals in parallel with respect to the common electrodes 19*a*, and coupled with the base ends of the drive electrodes 18*b* disposed on the inner wall surfaces of the dummy channels 12B. The coupling portions 19*c* are disposed on the base end sides of the common terminals 19*a* and the drive terminals 19*b*, and couple the pair of drive terminals 19*b* connected to the drive electrodes 18*b* on the pair of piezoelectric elements 11 that hold the jet channel 12A therebetween.

The cover plate 16 is a rectangular plate superimposed on the actuator plate 15, and disposed so as to cover the channels 12. On one surface side (opposite side of the actuator plate 15 side) of the cover plate 16, the concave groove-like ink chamber 10 that is rectangular in plan view and extends in the longitudinal direction (Y direction) of the cover plate 16 is formed. In the bottom surface of the ink chamber 10, rectangular ink introduction apertures 9 that pass through another surface side (actuator plate 15 side) of the cover plate 16 are formed. The ink chamber 10 communicates with the jet channels 12A through the ink introduction apertures 9. That is, the ink introduction apertures 9 are disposed above the jet channels 12A. On the other hand, no ink introduction apertures 9 are formed above the dummy channels 12B.

The passage substrate 42 illustrated in FIG. 2 is joined to one surface side of the cover plate 16 so as to be superimposed thereon, and the ink chamber 10 communicates with a circulation path (not shown) of the passage substrate 42.

Returning to FIG. 4, the nozzle plate 14 is a rectangular plate joined to the end surface of the actuator plate 15 on the channel leading end side, and is disposed so as to close the leading ends of the channels 12. The plurality of nozzle openings 13 are aligned on the nozzle plate 14 in a line in the channel parallel direction (Y direction). Those nozzle openings 13 are arranged at the leading end positions of the jet channels 12A, and not arranged at the leading end positions of the dummy channels 12B.

The nozzle cap 8 is a block body including an opening 8*a* into which the actuator plate 15 and the cover plate 16 are inserted, and is joined to the back surface (surface on the opposite side of the surface facing the recording medium S) of the nozzle plate 14.

(Integrated Wiring)

Figure 6:
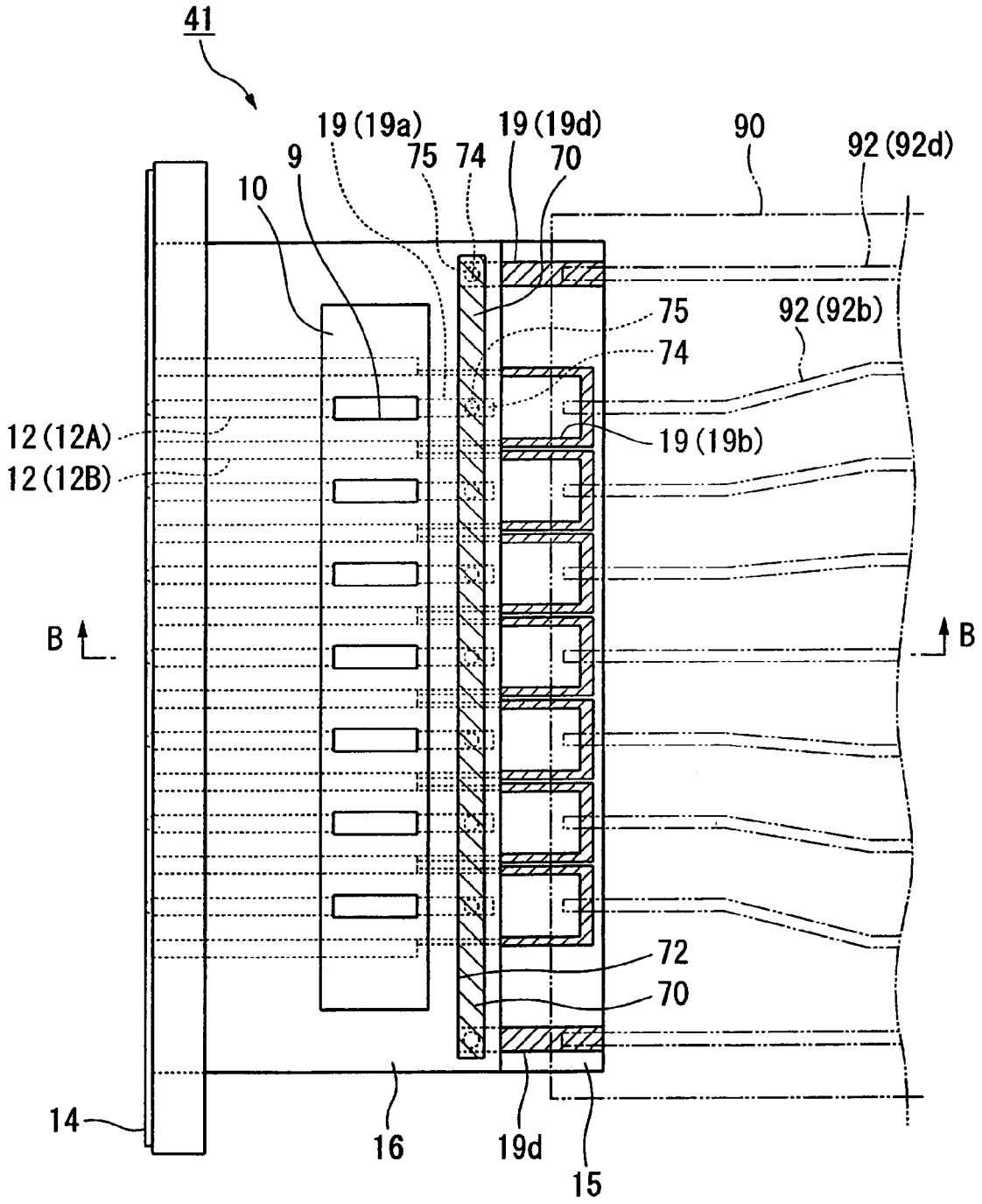
FIG. 6 is a plan view of the head chip according to the embodiment.
Figure 7:
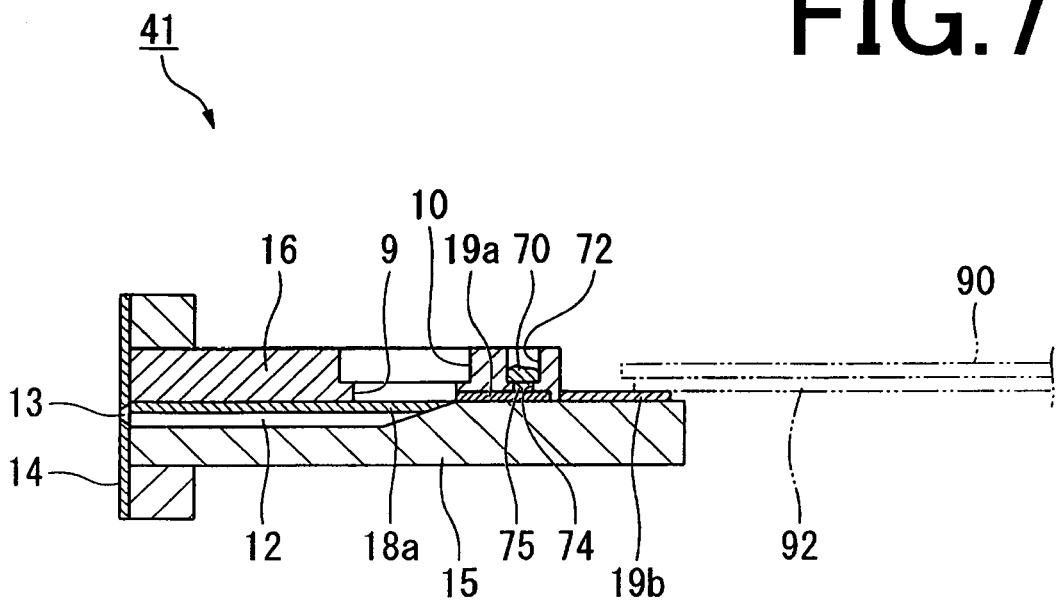
FIG. 7 is a cross-sectional view taken along the line B-B of FIG. 6.

FIG. 6 is a plan view of the head chip according to this embodiment, and FIG. 7 is a cross-sectional view taken along the line B-B of FIG. 6. In FIGS. 6 and 7, for easy understanding, the shapes of the common electrodes 19*a* and the drive terminals 19*b* (and coupling portions 19*c*) are simplified for drawing. In the following description, the pair of drive terminals connected to the drive electrodes for the pair of piezoelectric elements that hold each jet channel therebetween and the coupling portions that couple the pair of drive terminals are called "drive terminals 19*b*" as a whole.

As illustrated in FIG. 6, the plurality of drive terminals 19*b* are aligned in line at the end of the actuator plate 15. Both ends of the plurality of drive terminals 19*b* include integrated terminals 19*d* formed therein, which are described later.

In this embodiment, the cover plate 16 is arranged so as to cover the plurality of common electrodes 19*a* entirely and the ends of the integrated terminals 19*d*. Conversely, the plurality of common electrodes 19*a* entirely and the ends of the integrated terminals 19*d* are formed at a position where those elements are covered with the cover plate 16. The cover plate 16 is made of the same ceramic-based material as that of the actuator plate 15. For that reason, the cover plate 16 has the same linear thermal expansion coefficient as that of the actuator plate 15.

A groove 72 is formed along the end side of the cover plate 16 on the base end side. The groove 72 is formed so as to straddle all the common terminals 19*a* and the ends of the integrated terminals 19*d*. As illustrated in FIG. 7, through-holes 74 that pass through the cover plate 16 are formed from the bottom surface of the groove 72 toward the common terminals 19*a* and the integrated terminals 19*d*. In this embodiment, as illustrated in FIGS. 6 and 7, the common terminals 19*a*, the through-holes 74, and the ink introduction apertures 9 are formed at respective corresponding positions (along the extending direction of the jet channel 12A).

The through-holes 74 are filled with a conductive material to form contact plugs 75, and the groove 72 is filled with a conductive material to form an integrated wiring 70. Ag paste or the like is used as the conductive material. The integrated wiring 70 is configured to electrically connect at least a part of the plurality of common terminals 19*a*. The integrated wiring 70 of this embodiment electrically connects all of the common terminals 19*a* through the contact plugs 75. As illustrated in FIG. 6, both ends of the integrated wiring 70 are connected with the integrated terminals 19*d* through the contact plugs 75.

On the other hand, an end of the actuator plate 15 is equipped with one end of the flexible substrate 90. More specifically, the drive terminals 19*b* and the integrated terminals 19*d* aligned at the end of the actuator plate 15 are electrically connected to the wirings 92 formed on the flexible substrate 90 through an anisotropic conductive film (not shown) or the like. The other end of the flexible substrate 90 is mounted on the wiring substrate 45 illustrated in FIG. 2. An electric signal is input to the drive terminals 19*b* of the head chip from the control circuit 45*a* mounted on the wiring substrate 45 through the wirings 92*b* of the flexible substrate 90 illustrated in FIG. 6. Further, the integrated terminals 19*d* of the head chip 41 are grounded through the wirings 92*d* of the flexible substrate 90.

As described above, the head chip 41 according to this embodiment includes the integrated wiring 70 that integrates all of the common terminals 19*a*, and has a configuration in which the integrated terminals 19*d* connected to the integrated wiring 70 and the drive terminals 19*b* connected to the drive electrodes are aligned at the end of the actuator plate 15. With that configuration, the number of terminals is reduced as compared with the related art in which all of the common terminals 19*a* and drive terminals 19*b* are aligned, and the respective terminals 19*b* and 19*d* can be arranged at wider pitches. As a result, short-circuit between the terminals can be prevented. Accordingly, there can be provided a liquid jet recording device excellent in electric reliability.

In addition, it is possible to increase the line width of the respective terminals 19*b* and 19*d*. As a result, when the flexible substrate 90 is mounted, it is possible to facilitate the alignment of the wirings 92*b* and 92*d* of the flexible substrate 90 with the respective terminals 19*b* and 19*d* of the head chip 41.

Further, in this embodiment, the integrated terminals 19*d* are arranged at the ends of the plurality of drive terminals 19*b*. With this configuration, the wirings 92 of the flexible substrate 90 are not connected to the common terminals 19*a* or the integrated terminals 19*d* over the drive terminals 19*b*. Accordingly, short-circuit between the drive terminals 19*b* and the common terminals 19*a* or the integrated terminals 19*d* due to the wirings 92 can be prevented.

Further, in this embodiment, the integrated terminals 19*d* are connected to both ends of the integrated wiring 70. With that configuration, variations of potentials at the plurality of common terminals 19*a* can be reduced as compared with a case in which the integrated terminal 19*d* is connected to only one end of the integrated wiring 70. As a result, it is possible to improve the operation accuracy of the piezoelectric elements, and liquid can be stably ejected from the jet channels.

(Manufacturing Method)

Next, a description is given of a method of manufacturing the head chip according to this embodiment. First, as illustrated in FIG. 6, the above-mentioned actuator plate 15 and cover plate are prepared. The respective channels 12, the respective electrodes, the respective terminals 19, and the like are formed on the actuator plate 15 in advance. In addition, the ink chamber 10 and the ink introduction apertures 9 as well as the grooves 72 and the through-holes 74 are formed in the cover plate 16 in advance.

Then, the through-holes 74 of the cover plate 16 are aligned to the common terminals 19*a* and the integrated terminals 19*d* formed on the actuator plate 15. When the ink introduction apertures 9 of the cover plate 16 are aligned to the jet channels 12A of the actuator plate 15, the common terminals 19*a*, the through-holes 74, and the ink introduction apertures 9 are formed at the corresponding positions as described above, whereby the alignment of the through-holes 74 with the common terminals 19*a* can be also performed at the same time. In this example, the cover plate 16 has the same linear thermal expansion coefficient as that of the actuator plate 15, and thus the amount of expansion and contraction is equal to each other between both of those members even if the ambient temperature changes. Accordingly, those members can be easily aligned irrespective of the ambient temperature.

Subsequently, the cover plate 16 is joined to the surface of the actuator plate 15 with an adhesive made of a resin material or the like. The adhesive is applied on the entire joint surface of the actuator plate 15 with the cover plate 16. In this case, when the cover plate 16 is pushed against the surface of the actuator plate 15, the adhesive may flow (overflow) into the through-holes 74 formed in the cover plate 16. When the contact plugs 75 are formed with the adhesive flowing into the through-holes 74, the contact plugs 75 and the common terminals 19*a* or the integrated terminals 19*d* cannot be electrically connected to each other.

Under the circumstances, the adhesive that has flowed into the through-holes 74 is removed. More specifically, the insides of the through-holes 74 are irradiated with a laser to remove the adhesive therefrom. In particular, the irradiation of an excimer laser or the like enables only a resin material of the adhesive to be selectively removed without need for removing a ceramic-based material of the actuator plate 15 and the cover plate 16. Alternatively, the surfaces of the actuator plate 15 and the cover plate 16 may be subjected to ashing to remove the adhesive inside the through-holes 74.

Then, as illustrated in FIG. 7, the insides of the groove 72 and the through-holes 74 are filled with a conductive material. More specifically, the insides of the groove 72 and the through-holes 74 are applied with a conductive paste such as Ag paste by using a dispensing method, a printing method, or the like. Then, the applied conductive paste is heated to be cured. As a result, the integrated wiring 70 is formed inside the groove 72, and the contact plugs 75 are formed inside the through-holes 74. Instead of application of the conductive paste, a conductive material may be filled through a vapor deposition method or the like.

In this embodiment, the adhesive that has flowed into the through-holes 74 is removed to form the contact plugs 75. This enables the contact plugs 75, and the common terminals 19*a* and the integrated terminals 19*d* to be electrically connected to each other without fail.

Modified Example

Figure 8:
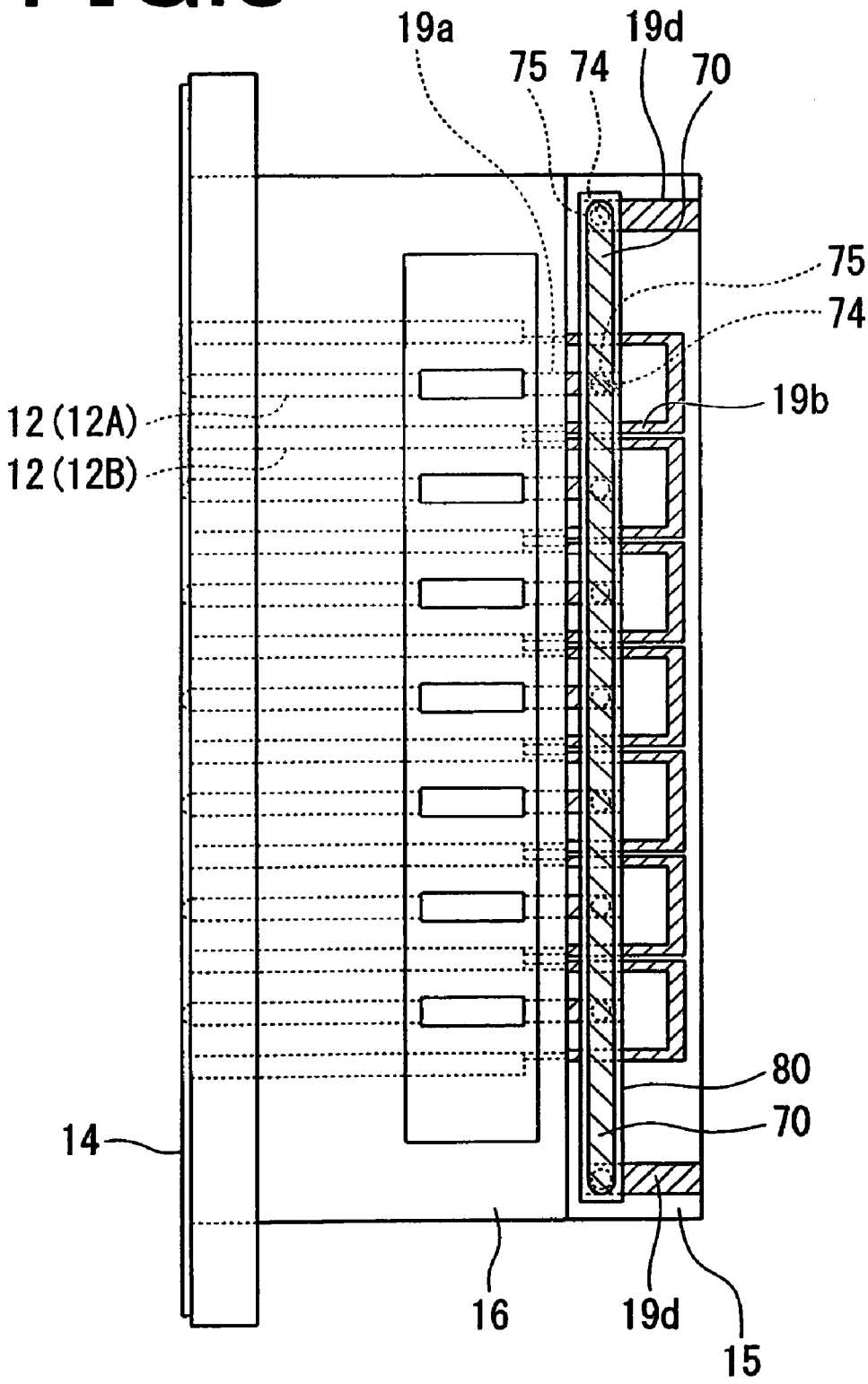
FIG. 8 is a plan view of a head chip according to a modified example of the embodiment.
Figure 9:
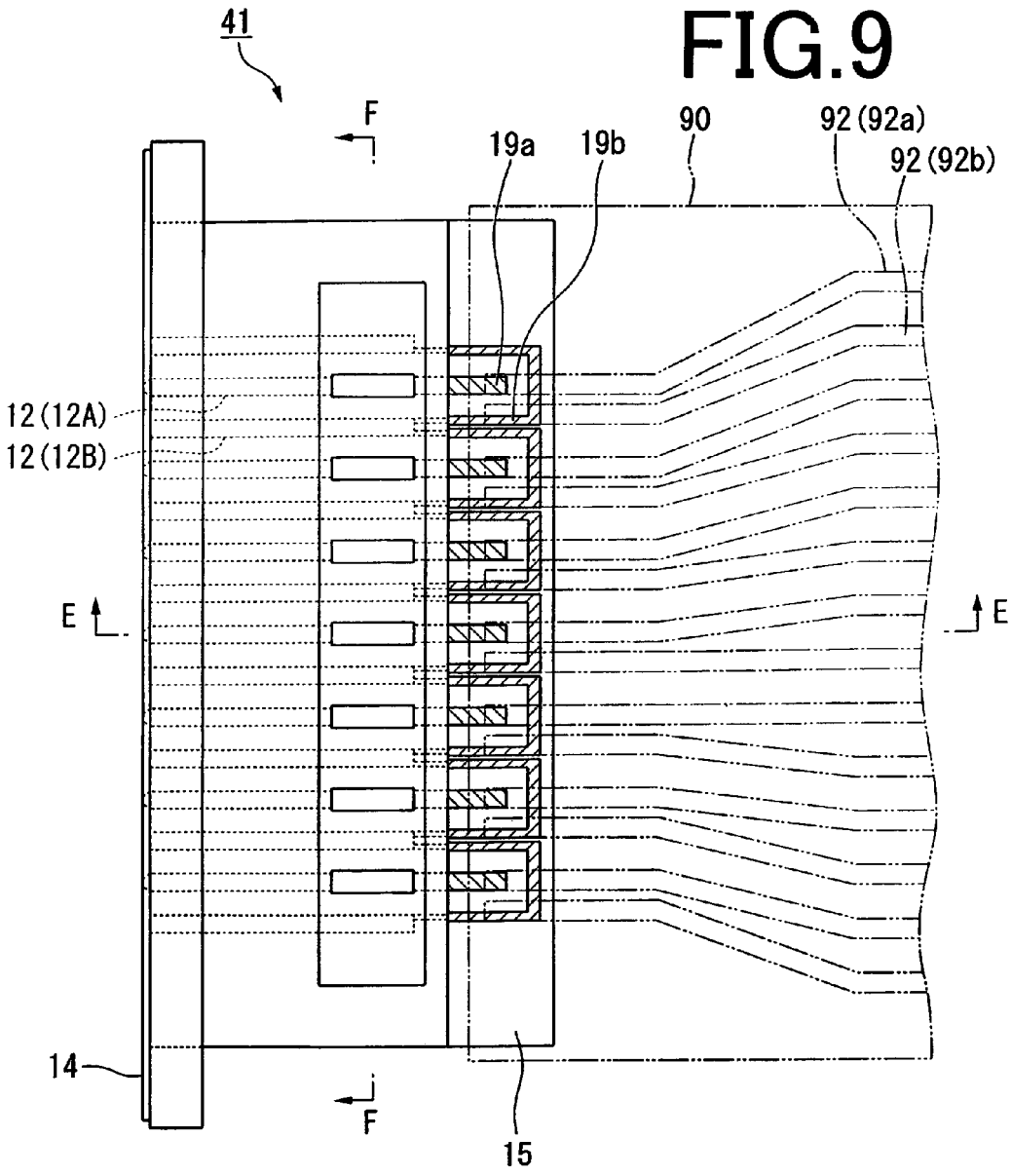
FIG. 9 is a plan view of a head chip according to a related art.
Figure 10:
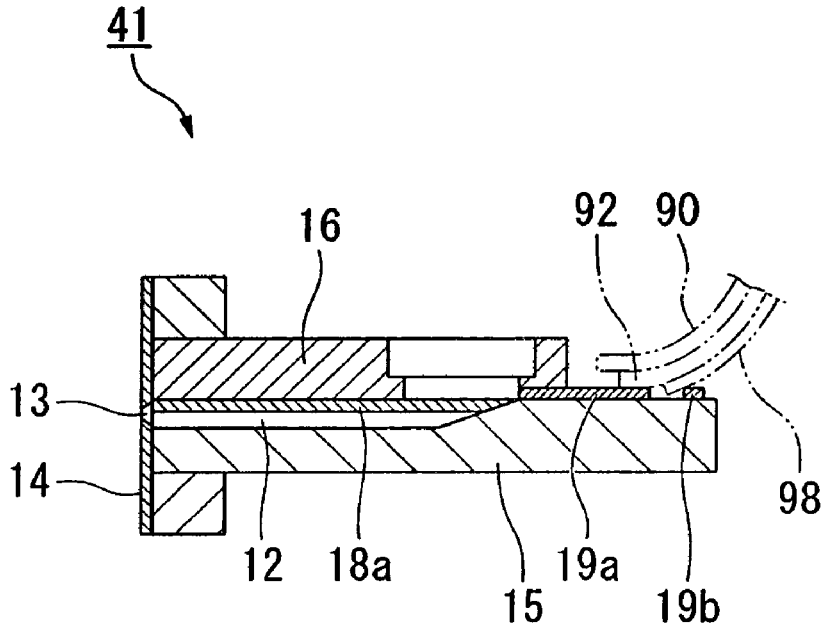
FIG. 10 is a cross-sectional view taken along the line E-E of FIG. 9.

FIG. 8 is a plan view of a head chip according to a modified example of the embodiment. In this modified example, an integrated plate 80 different from the cover plate 16 is provided, and the integrated wiring 70 and the contact plugs 75 are formed on the integrated plate 80. The integrated plate 80 is made of the same ceramic-based material as that of the actuator plate 15, and has the same linear thermal expansion coefficient as that of the actuator plate 15. Accordingly, as in the above-mentioned embodiment, the through-holes 74 of the integrated plate 80 can be readily aligned to the common terminals 19*a* and the integrated terminals 19*d* formed on the actuator plate 15.

In this modified example, however, there is a need to provide the integrated plate 80 for forming the integrated wiring 70 in addition to the cover plate 16. On the contrary, in the above-mentioned embodiment, the integrated wiring is formed on the cover plate itself, whereby the manufacturing costs can be reduced as compared with those of this modified example.

The technical scope of the present invention is not limited to the above-mentioned embodiment, but includes various modifications added to the above-mentioned embodiment without departing from the spirit of the present invention. That is, the specific materials and the layer configurations described in the embodiment are merely one example, and can be appropriately altered.

For example, in the above-mentioned embodiment, the nozzle openings are disposed at the end in the channel extending direction, but the present invention may be configured so that the nozzle openings are formed in the bottom surface of the jet channels.

In the above-mentioned embodiment, as illustrated in FIG. 5, the jet channels 12A that are filled with ink and the dummy channels 12B that are not filled with ink are alternately formed, thereby making it possible to prevent short-circuit between the drive electrodes 18*b* of the adjacent jet channels 12A even if an aqueous ink having conductivity is used. As a result, the operation of the plurality of jet channels 12A can be controlled independently. The ink available by the head chip 41 of the present invention is not limited to aqueous ink. For example, oil-based ink, solvent ink, UV ink having no conductivity are available.

What is claimed is:

1. A head chip, comprising:

a plurality of liquid jet channels formed in an actuator plate;

nozzles that communicate with the plurality of liquid jet channels and that eject liquid from the liquid jet channels;

a pair of piezoelectric elements that hold each of the plurality of liquid jet channels therebetween;

common electrodes formed on surfaces of the pair of piezoelectric elements on the liquid jet channel side;

drive electrodes formed on surfaces of the pair of piezoelectric elements, the surfaces being opposite to the surfaces on which the common electrodes are formed;

common terminals connected to the common electrodes and formed on a surface of the actuator plate;

an integrated plate that covers a plurality of the common terminals; and an integrated wiring that is formed on a surface of the integrated plate and electrically connects at least a part of the plurality of common terminals, wherein the integrated wiring is connected to the common terminals through through-holes of the integrated plate, and wherein the actuator plate includes integrated terminals connected to the integrated wiring and drive terminals connected to the drive electrodes, the integrated terminals and the drive terminals being arranged at an end thereof.

2. A head chip according to claim 1, wherein the through-holes each include a contact plug formed therein, and wherein the integrated wiring is connected to the common terminals through the contact plug formed in each of the through-holes of the integrated plate.

3. A head chip according to claim 1, wherein the integrated plate has a linear thermal expansion coefficient equal to a linear thermal expansion coefficient of the actuator plate.

4. A head chip according to claim 1, wherein the integrated plate comprises a cover plate that covers the plurality of liquid jet channels.

5. A head chip according to claim 1, wherein the common electrodes comprise ground electrodes.

6. A head chip according to claim 1, wherein a pair of the integrated terminals connected to both ends of the integrated wiring are arranged at both ends of a plurality of the drive terminals.

7. A liquid jet head comprising the head chip according to claim 1.

8. A liquid jet recording device, comprising:

the liquid jet head according to claim 7;

liquid supply means for supplying a liquid to the plurality of liquid jet channels of the head chip; and recording medium conveying means for conveying a recording medium so as to pass through a position that faces the nozzles.

9. A method of manufacturing the head chip according to claim 1, comprising:

aligning the through-holes of the integrated plate to the common terminals formed on the surface of the actuator plate to join the integrated plate to the surface of the actuator plate with an adhesive;

removing the adhesive that has flowed into the through-holes; and forming the contact plugs inside the through-holes.

* * * * *